United States Patent [19]

Bell

[11] Patent Number: 4,596,229

[45] Date of Patent: Jun. 24, 1986

[54] BOW TUNING AID

[76] Inventor: Elmo E. Bell, Box 424, Lake Serene, North, Hattiesburg, Miss. 39401

[21] Appl. No.: 683,629

[22] Filed: Dec. 19, 1984

[51] Int. Cl.[4] ..... F41B 5/00; F41G 1/00; G01B 3/30

[52] U.S. Cl. ..... 124/24 R; 124/88; 33/180 R; 33/265

[58] Field of Search ..... 124/23 R, 24 R, 86, 124/88, DIG. 1, DIG. 91

[56] References Cited

U.S. PATENT DOCUMENTS

| | | | |
|---|---|---|---|
| 3,377,999 | 4/1968 | Reynolds | 124/88 |
| 3,866,592 | 2/1975 | Carella | 124/24 R |
| 4,368,719 | 1/1983 | Christopher | 124/88 |
| 4,452,222 | 6/1984 | Quartino et al. | 124/88 |

*Primary Examiner*—Richard C. Pinkham
*Assistant Examiner*—Benjamin Layno

[57] ABSTRACT

A mechanical device that is attached to the handle of an archery bow and used to determine the path followed by the nock end of the arrow when the bow is drawn and the arrow released. The path followed by the nock end of the arrow is the basis for making adjustments to improve the attitude of the arrow as it begins its flight.

5 Claims, 7 Drawing Figures

BOW TUNING AID

BACKGROUND OF THE INVENTION

1. Field of the Invention

This invention deals with the field of archery and more specifically is a device for adjusting or tuning bows. The device enables the user to determine what adjustments must be made to improve arrow flight.

2. Description of the Prior Art

The accepted method of tuning bows, now as in the past, is based on trial and error. Fletched and unfletched arrows are shot at varying ranges and trial adjustments are made. This process is continued until the archer is satisfied with the grouping of his arrows. This method requires extensive shooting over a considerable period of time and the results are often disappointing. Prior to this invention, there was no known method for determining the precise attitude of the arrow, in relation to other bow features, at the start of its flight.

SUMMARY OF THE INVENTION

The Bow Tuning Aid is a mechanical device consisting of three principal parts; the extension bar, the sliding block and the locator rod. The extension bar is fitted with a dovetail tenon and lock screw at one end to facilitate attachment to the archery bow. The locator rod is straight round stock with one end turned to a taper ending in the shape of a round ball. The sliding block has one hole drilled to accept the extension bar and a traverse hole to accept the locator rod. The sliding block is equipped with lock screws to secure the sliding block and the locator rod in position on the extension bar.

The purpose of the device is to determine the precise point from which the nock end of the arrow begins its flight when an arrow is nocked on the bow string, and the bow is drawn and shot in the normal manner. The path followed by the nock end of the arrow provides the basis for adjusting the adjustable parts of the bow to improve the flight of the arrow.

DETAILED DESCRIPTION OF THE PREFERRED EMBODIMENTS

Figure 1:
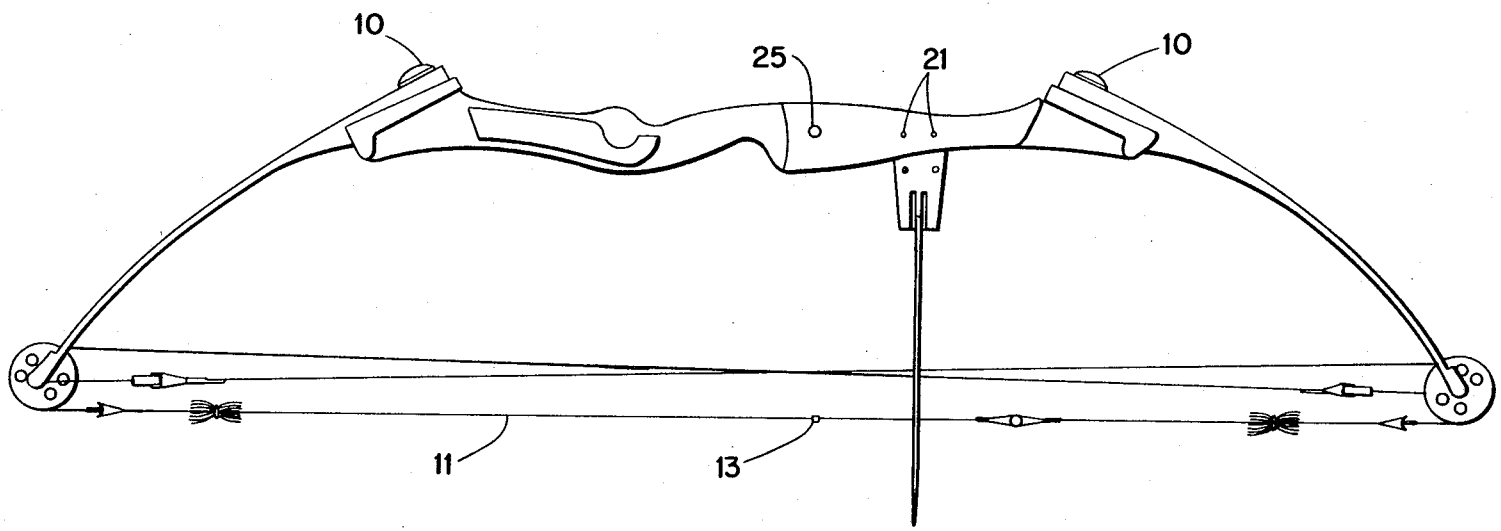
FIG. 1 illustrates the bow and identifies pertinent parts.
Figure 4:
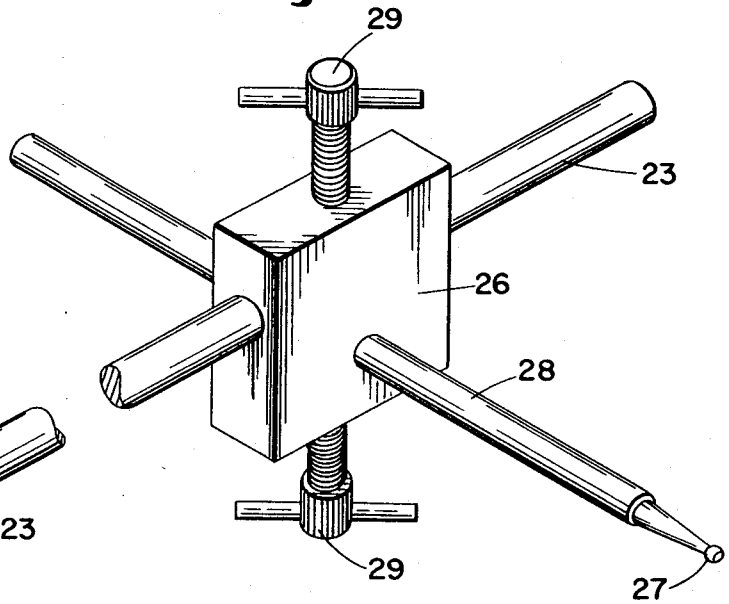
FIG. 4 illustrates the sliding block that is free to slide and rotate on the extension bar until it is locked in place by means of the lock screw. This view also illustrates the locator rod that may be extended or retracted and locked in place with the lock screw.
Figure 2:
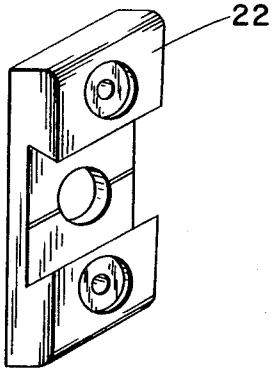
FIG. 2 illustrates a typical sight mounting bracket that is attached to the bow by means of two studs and the threaded holes in the bow riser.
Figure 3:
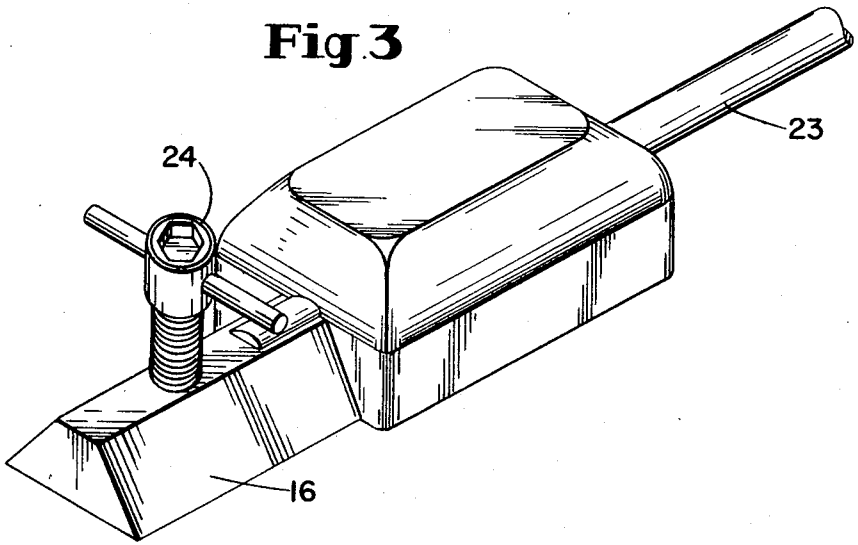
FIG. 3 is a fragmentary view of the dovetail tenon and locking screw on the end of the extension bar. The dovetail tenon fits into the dovetail mortise of the sight mounting bracket shown in FIG. 2.
Figure 5:
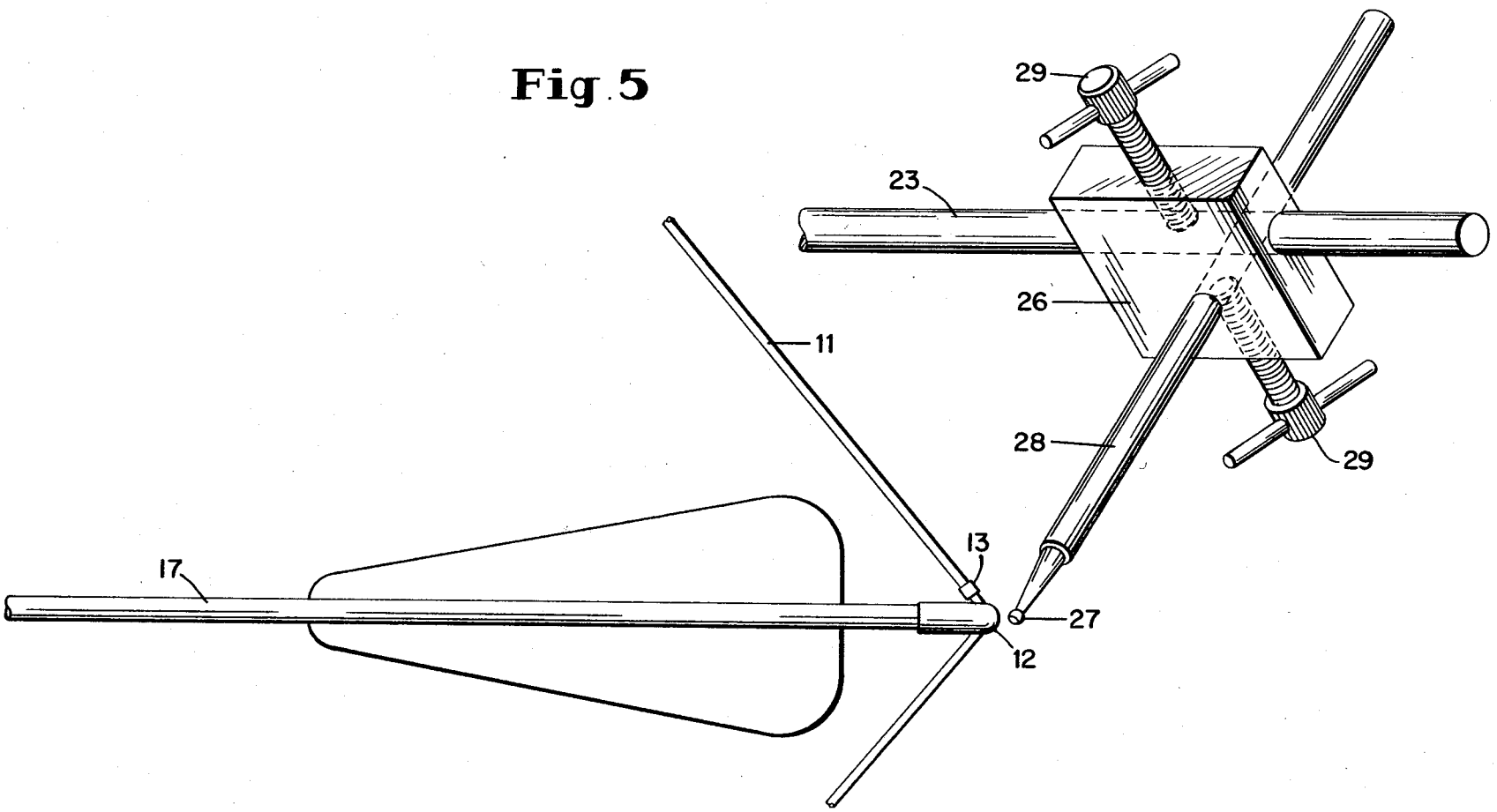
FIG. 5 is a fragmentary view of the sliding block, locator rod and lock screws. This drawing illustrates the positioning of the locator rod button behind the nock of the arrow and in line with the axis of the arrow to identify the precise point from which the nock end of the arrow begins its flight when the string is released.
Figure 6:
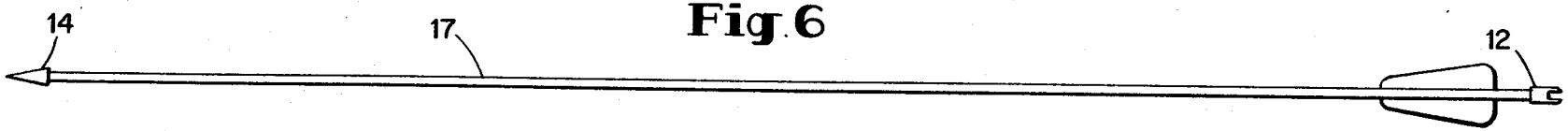
FIG. 6 illustrates the pertinent parts of the arrow.
Figure 7:
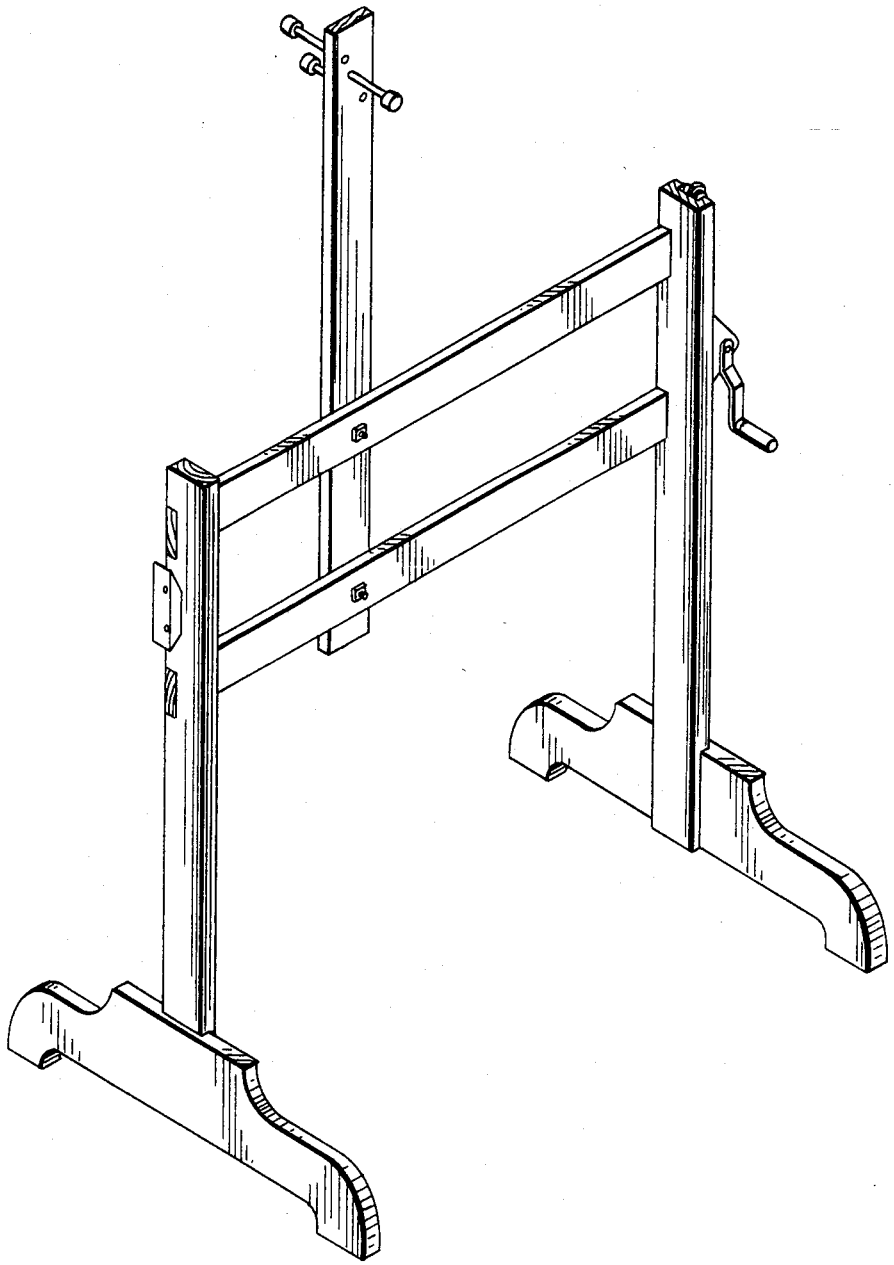
FIG. 7 illustrates a holding rack that is used in conjunction with the Bow Tuning Aid. The holding rack is not a part of this invention.

Quality bows of recent manufacture have two threaded holes (21) in the riser that are intended to accept sights, sight brackets, cable guards and/or quivers. A sight bracket with a dovetail mortise (22) is attached with two studs utilizing the two holes mentioned above (21). The dovetail tenon (16) on the extension bar (23) is secured in the sight bracket by means of a lock screw (24). The bow is secured in a holding rack. (The holding rack is not a part of this invention, it is merely a rack that holds the bow in a vertical position and includes a windlass for drawing the bow and holding the string in the drawn position.) An arrow is placed on the arrow rest (25) and nocked on the bow string (11). The bow is then drawn to the users normal draw length and held in the drawn position. The sliding block (26) is positioned on the extension bar (23) and rotated as necessary to facilitate positioning the round button (27) on the end of the locator rod (28) immediately behind the arrow nock (12). The round button is centered on the axis of the arrow. During this step the sliding block and locator rod are locked in this position using the two lock screws (29) provided for this purpose. The bow string (11) is now allowed to return to the relaxed position. With the bow in the relaxed or undrawn position the arrow is positioned on the arrow rest (25) and the nock (12) continues to be positioned on the string by means of the nock point (13). The user is now ready to make his observations. The user may sight along the shaft of the arrow from the point end (14) to determine from the position of the button on the locator rod (27) in relation to the arrow's axis, whether the nock end of the arrow moves up, down, left or right when the bow is drawn.

The bow string and the nock end of the arrow do not necessarily move in a straight line when the bow is drawn. Limb twist or a lateral shift in the limb and riser juncture causes the string to move left or right as the bow is drawn. The nock point on the bow string may move up or down when the bow is drawn because the two bow limbs have different resistance to bending or because the nock point is not positioned at the center of the string's length.

After using the Bow Tuning Aid to determine the path, which is usually curved, that is followed by the nock end of the arrow, the user has the basis for adjusting or tuning the bow. Adjustments are made to place the arrow in such an attitude that the lines of force imparted by the bow string will be parallel to the axis of the arrow both vertically and horizontally. Positioning the arrow in this manner minimizes the yaw present in the attitude of the arrow at the start of it's flight.

In the light of this disclosure, numerous variations in construction details of the Bow Tuning Aid will occur to those skilled in the art without departing from the principle and spirit of the underlying invention. For example, the device may be attached to the bow's cable guard or to the bow riser by other means. It is desired to include within the scope of the following claims all such changes and modifications by which substantially similar results may be obtained through the use of the same or equivalent means.

What is claimed is:

1. A bow tuning aid capable of being attached to an archery bow for precisely locating a nock end of an arrow at the full draw position, thereby enabling the user to determine whether bow adjustments are necessary to improve an arrow flight comprising , an extension bar, means carried by said bar for mounting it on an archery bow;

a block slidably mounted on said bar;

a locator rod, means on said rod for precisely locating a nock end of an arrow at the full draw position, said block having a first hole adjustably receiving said locator rod and a second hole for slidably receiving said extension bar;

means for locking said block in a selected position to said extension bar; and means for locking said locator rod in an adjusted position to said sliding block.

2. The bow tuning aid of claim 1, wherein said locator rod is positioned substantially perpendicular to said extension bar.

3. The bow tuning aid of claim 1, wherein said means locking said sliding block to said extension bar and said means for locking said locator rod to said sliding block comprise, a pair of lock screws mounted on said sliding block.

4. The bow tuning aid of claim 1, wherein said locator rod means for locating the nock end of an arrow comprises, a round button at one end of said rod, serving as a reference point for precisely locating said nock end of the arrow.

5. The bow tuning aid of claim 1, wherein said means for mounting said extension bar to an archery bow comprises, a dovetail tenon formed on said extension bar, and a third lock screw mounted on said dovetail tenon, and said aid further comprises a dovetail mortise capable of being attached to an archery bow, said dovetail tenon adapted to receive said dovetail mortise and said third lock screw adapted to lock said dovetail tenon to said dovetail mortise.

* * * * *